United States Patent [19]

Sakamoto

[11] Patent Number: 4,879,986

[45] Date of Patent: Nov. 14, 1989

[54] MALFUNCTION DETECTION OF AN ENGINE EXHAUST GAS RECIRCULATION SYSTEM

[75] Inventor: Masanori Sakamoto, Tokyo, Japan

[73] Assignee: Fuji Jukogyo Kabushiki Kaisha, Tokyo, Japan

[21] Appl. No.: 234,142

[22] Filed: Aug. 19, 1988

[30] Foreign Application Priority Data

Aug. 25, 1987 [JP] Japan ..... 62-212191

[51] Int. Cl.[4] ..... F02M 25/06

[52] U.S. Cl. ..... 123/571; 364/431.06

[58] Field of Search ..... 123/568, 569, 570, 571; 364/431.06

[56] References Cited

U.S. PATENT DOCUMENTS

| | | | |
|---|---|---|---|
| 4,375,800 | 3/1983 | Otsuka et al. | 123/571 |
| 4,428,355 | 1/1984 | Yokooku | 123/571 |
| 4,442,820 | 4/1984 | Ina et al. | 123/571 |
| 4,448,177 | 5/1984 | Hasegawa et al. | 123/571 |
| 4,541,398 | 9/1985 | Kishi | 123/571 |
| 4,665,882 | 5/1987 | Otobe | 123/571 |
| 4,715,348 | 12/1987 | Kobayashi et al. | 123/571 |
| 4,770,146 | 9/1988 | Shibata et al. | 123/571 |
| 4,793,318 | 12/1988 | Tsurusaki | 123/571 |

*Primary Examiner*—Willis R. Wolfe

*Attorney, Agent, or Firm*—Beveridge, DeGrandi & Weilacher

[57] ABSTRACT

Malfunctions in an exhaust gas recirculation system, particularly on manual transmission vehicles which may be accelerated during a startup period with a rapid succession of upshifts during which exhaust gas recirculation is suspended, is detected from the output of a thermistor positioned on the passageway of the recirculating exhaust gas. In order to allow for the unavoidable delay in gas temperature measurement by the thermistor, a prescribed length of delay time is set up on commencement of exhaust gas recirculation as manifested by the fact that a predetermined set of engine operating conditions have all become satisfied. During the delay time, periods during which exhaust gas actually recirculates are cumulatively summed up, and the sum is compared upon lapse of the delay time with a reference time which is less than the delay time. A possible malfunction in the exhaust gas recirculation system is detected on the basis of the maximum temperature of the recirculating exhaust gas only in cases where the sum is not less than the reference time. A warning will be given if the maximum gas temperature is found not more than a predetermined limit value.

6 Claims, 3 Drawing Sheets

MALFUNCTION DETECTION OF AN ENGINE EXHAUST GAS RECIRCULATION SYSTEM

BACKGROUND OF THE INVENTION

This invention relates to the detection of malfunctions that may occur in exhaust gas recirculation (EGR) systems of internal combustion engines. More specifically, the invention pertains to a method of, and apparatus for, diagnosing an automotive engine EGR system for possible malfunctions by sensing the temperature of the recirculating exhaust gas with a thermistor or like temperature sensor. The method and apparatus of the invention are particularly well suited for use with EGR systems of manual transmission, rather than automatic transmission, vehicles.

EGR constitutes one of the long familiar methods of cleaning the automotive exhaust gas for the reduction of air pollution. In its simplest form the EGR system comprises a valve, commonly referred to as the EGR valve, for opening and closing a special passageway connecting the exhaust manifold with the intake manifold. The EGR valve is vacuum operated to open when the throttle is opened, with the result that part of the exhaust gas passes into the intake manifold. Such recirculation of exhaust gas serves to reduce the combustion temperature and to lower the formation of nitrogen oxides.

The performance of the engine itself is hardly affected even if the exhaust gas does not recirculate because of the malfunction of the EGR valve. In all likelihood, therefore, the vehicle operator will not notice such malfunctions unless means are incorporated with the EGR system for constantly checking it for possible malfunctions and for giving an alarm upon detection of a malfunction.

A well known example of such checking means is a temperature sensor provided on the exhaust gas passageway from exhaust manifold to intake manifold. Whether the exhaust gas is recirculating as required or not is ascertained from the temperature of the exhaust gas passageway. Japanese Utility Model Publication No. 52-31886 is hereby cited as a typical prior art device employing the temperature sensor. The prior art device additionally comprises a serial connection of a switch responsive to the temperature sensor, another switch responsive to engine speed, and an alarm. The alarm is actuated when the exhaust gas temperature drops below a certain limit for some malfunctions of the EGR system when the engine speed is high.

There is one consideration that must go into the design of diagnostic systems with use of thermistors as the exhaust gas temperature sensors. The thermistor, as is well known, is a resistive circuit element whose resistance varies in a known manner with the temperature. Its response is not very good; the response time may be as long as several seconds for correct measurement of the temperature.

It might, therefore, be contemplated to diagnose the performance of the EGR system by the indications of the thermistor only when the prescribed engine operating conditions for justifying exhaust gas recirculation lasts for a preassigned length of time. The greatest justification for exhaust gas recirculation comes at the time of hard acceleration immediately following vehicle startup, with the throttle opened to more than a certain degree and with the engine speed rapidly building up. During such hard acceleration, however, the ER system operates either continuously or discontinuously depending upon whether the engine is equipped with an automatic or a manual transmission. The automatic transmission automatically shifts to higher gears as the vehicle operator keeps stepping on the accelerator pedal. Exhaust gas will continuously recirculate during such automatic upshifting. Malfunction diagnosis with the thermistor is possible during the continuous gas recirculation.

However, with the manual transmission, the vehicle operator usually makes a rapid succession of manual upshifts as the vehicle speed builds up by the depression of the accelerator. Exhaust gas does not recirculate during the manual upshifts. If the intervals of the upshifts are each shorter than the preassigned length of time, no diagnosis will be made during the startup period. As far as the applicant is aware, there has been suggested no satisfactory method nor apparatus for effectively detecting malfunction in the EGR systems on manual transmission vehicles in the face of the rapid succession of manual upshifts.

SUMMARY OF THE INVENTION

The present invention provides a truly satisfactory solution to the above discussed problems, making it possible to accurately detect malfunctions in EGR systems on manual transmission vehicles, in addition to those on automatic transmission vehicles, despite the noted delay in sensing the temperature of the recirculating exhaust gas by a thermistor or the like and despite the noted rapid succession of manual upshifts for hard acceleration during a startup period.

Briefly, the invention is directed to an EGR system for an internal combustion engine, wherein exhaust gas recirculates only when a prescribed set of working conditions of the engine are met, and wherein a temperature sensor such as a thermistor is provided for sensing the temperature of the exhaust gas being recirculated. The invention dictates the constant monitoring of the prescribed set of engine working conditions for the commencement and progress of exhaust gas recirculation. A prescribed length of delay time is set up when the engine working conditions become satisfied, and during this delay time those periods of time during which the engine working conditions are met are cumulatively added together. Then, upon lapse of the delay time, the sum of the times during which the engine working conditions have been met is compared with a predetermined reference time which is a minimal time required for accurate measurement of the temperature of the recirculating exhaust gas by the temperature sensor in use and which is less than the delay time. Only when the sum is not less than the reference time, the EGR system is diagnosed for possible malfunctions on the basis of the maximum temperature of the exhaust gas sensed by the temperature sensor.

In an EGR system on manual transmission vehicles, exhaust gas recirculation may be suspended one or more times during the above defined delay time as a result of gearshifting. Despite such possible suspension or suspensions the actual periods of exhaust gas recirculation during each delay time are summed up, and the required diagnostic operation is performed if this sum is not less than the reference time. Accurate malfunction detection is therefore possible even during hard acceleration in the startup period of manual transmission vehicles, in spite of the unavoidable delay in the measurement of the recirculating gas temperature.

The above and other features and advantages of this invention and the manner of realizing them will become more apparent, and the invention itself will best be understood, from a study of the following description and appended claims, with reference to the attached drawings showing a preferred embodiment of the invention.

DETAILED DESCRIPTION OF THE INVENTION

General

Figure 1:
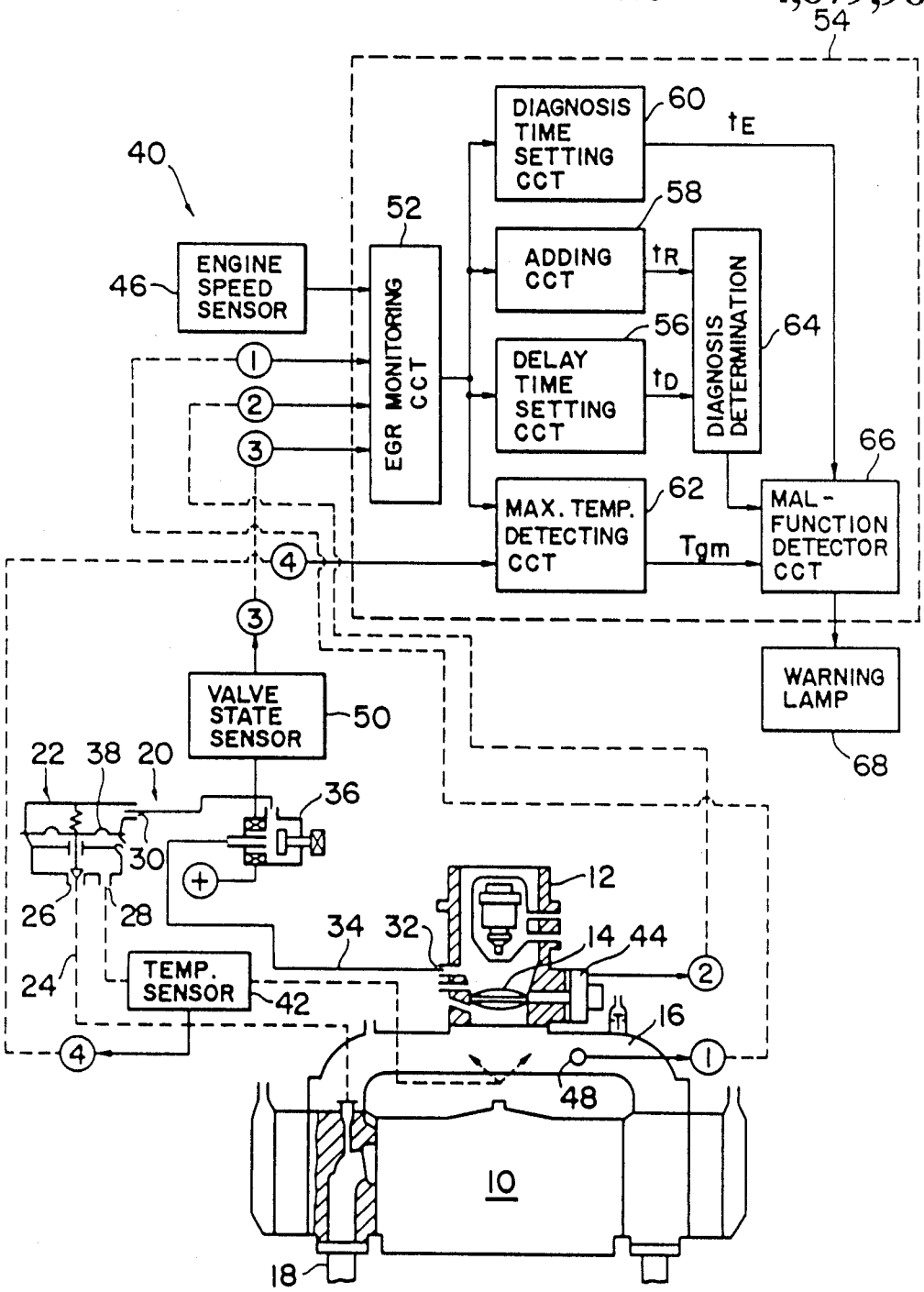
FIG. 1 is a combined schematic and block diagrammatic representation of an automotive engine exhaust gas recirculation system shown together with a preferred form of the malfunction detection system in accordance with the invention.

At 10 in FIG. 1 is shown an automotive internal combustion engine conventionally comprising a throttle body 12 with a throttle valve 14 mounted therein, an intake manifold 16 and an exhaust manifold 18. The engine 10 is provided with an EGR system 20 for supplying part of the exhaust gas from the exhaust manifold 18 back into the intake manifold 16 under predefined operating conditions of the engine. FIG. 1 also shows a malfunction detection system 40 for the EGR system 20. The malfunction detection system 40 detects the malfunctioning of the EGR system 20 in accordance with the novel concepts of the invention.

EGR System

The EGR system 20 comprises an EGR valve 22 on an exhaust gas recirculation line 24 extending from intake manifold 16 to exhaust manifold 18. The EGR valve 22 can be of conventional design having an inlet port 26 in communication with the exhaust manifold 18, an outlet port 28 in communication with the intake manifold 16, and a control port 30 in communication with a throttle body signal port 32 formed in the throttle body by way of a vacuum signal line 34. This line 34 is provided with a solenoid operated vacuum switch or valve 36 which is responsive to throttle opening for the on off control of communication between EGR valve control port 30 and the throttle body signal port 32.

In the operation of the EGR system 20, the solenoid valve 36 opens when the throttle valve 14 is opened to a predetermined degree, thereby communicating the throttle body signal port 32 with the EGR valve control port 30. Thereupon the partial vacuum created in the neighborhood of the throttle valve 14 within the throttle body 12 will act on an actuating diaphragm 38 of the EGR valve 22 thereby causing the same to open. Part of the exhaust gas will then recirculates through the EGR valve 22 into the intake manifold 16, where the gas mixes with the air fuel mixture and enters the engine cylinders. Such recirculation of the exhaust gas reduces the combustion temperatures of the engine 10 and, in consequence, the amount of nitrogen oxides emitted thereby.

Malfunction Detection System

Forming a part of the EGR malfunction detection system 40 is a temperature sensor 42, which typically takes the form of a thermistor, provided on the exhaust gas recirculation line 24 for measuring the temperature of the exhaust gas being recirculated or of the exhaust gas passageway itself.

The malfunction detection method of this invention dictates the constant monitoring of a prescribed set of the operating conditions of the engine 10 in order to ascertain the commencement and progress of exhaust gas recirculation. For monitoring such engine operating conditions, there are provided a throttle opening sensor 44, an engine speed sensor 46, a coolant sensor 48 and a solenoid valve state sensor 50. All these sensors 44, 46, 48 and 50 have their outputs coupled to a monitoring circuit 52 forming a part of an EGR malfunction detection control circuit 54.

Evaluating the supplied output signals from the sensors 44, 46, 48 and 50, the monitoring circuit 52 determines that the engine working conditions for exhaust gas recirculation have all been met when:

1. The solenoid valve 36 communicates the control port 30 of the EGR valve 22 with the signal port 32 of the throttle body 12;
2. The coolant temperature is not less than a predetermined limit;
3. The throttle opening is within the upper limit $\theta H$ and lower limit $\theta L$ in the graph of FIG. 2; and
4. The engine speed is within the upper limit NeH and lower limit NeL in FIG. 2.

Figure 2:
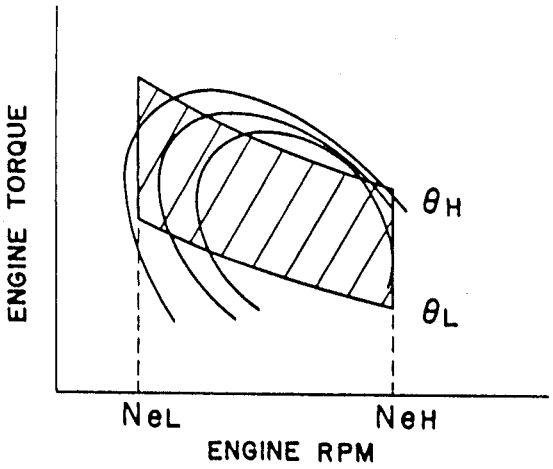
FIG. 2 is a graph plotting the curves of engine output torque against engine speed, the graph being explanatory of the engine output torque range and engine speed range in which exhaust gas recirculates in the EGR system of FIG. 1.

Exhaust gas recirculates in the hatched region of FIG. 2, provided that the other conditions are met. The monitoring circuit 52 puts out a signal indicative of exhaust gas recirculation when all these conditions are satisfied.

Connected to the output of the monitoring circuit 52 are a delay time setting circuit 56, an adding circuit 58, a diagnosis time setting circuit 60 and a maximum temperature detecting circuit 62. Upon commencement of exhaust gas recirculation, as manifested by the output from the monitoring circuit 52, the delay time setting circuit 56 sets up a prescribed length of delay time tD. During this delay time the adding circuit 58 cumulatively adds up the periods of time during which the noted engine working conditions are satisfied, that is, the periods of time during which exhaust gas actually recirculates, thereby computing the sum tR of these periods of time which is shorter than delay time tD. The diagnosis time setting circuit 60 also responds to the output from the monitoring circuit 52 by setting up a diagnosis time tE, longer than the delay time tD, at the end of which the EGR system 20 is to be diagnosed for the presence or absence of malfunctions ($tR < tD < tE$). More will be said during the subsequent description of operation about the functions of these circuits 56, 58 and 60.

The maximum temperature detecting circuit 62 has an additional input coupled to the temperature sensor 42 on the exhaust gas recirculation line 24. Upon commencement of exhaust gas recirculation the maximum temperature detecting circuit 62 compares the present value of the recirculating exhaust gas temperature signal with the previous values and stores the maximum value Tgm The delay time setting circuit 56 and adding circuit 58 both have their outputs coupled to a diagnosis determination circuit 64. Upon lapse of the preset delay time tD following the commencement of exhaust gas recirculation, the diagnosis determination circuit 64 compares the sum tR of the times during which exhaust gas actually recirculated, with a predetermined reference time tRl. This reference time tR1 is a minimum time required for accurate measurement of the recirculating exhaust gas temperature by the sensor 42 and is less than the delay time tD, which in turn is less than the diagnosis time tE as aforesaid. The diagnosis determination circuit 64 determines that a diagnosis of the EGR system 20 be conducted at the end of the diagnosis time, if the sum tR is equal to or more than the reference time tR1. If the sum tR is less than the reference time tR1, on the other hand, then no diagnosis will be performed this time because the exhaust gas has recirculated for a too short period of time for accurate measurement of its temperature by the thermistor or like temperature sensor 42.

The diagnosis time setting circuit 60, maximum temperature detecting circuit 62 and diagnosis determination circuit 64 have all their outputs coupled to a malfunction detector circuit 66. Only in cases where the sum tR of the times during which the exhaust gas recirculated is not less than the reference time tRl, as indicated by the output from the diagnosis determination circuit 64, the malfunction detector circuit 66 operates upon lapse of the diagnosis time tE to detect possible malfunctions in the EGR system 20 on the basis of the maximum temperature of the exhaust gas that has been ascertained by the maximum temperature detecting circuit 62.

The malfunction detector circuit 66 has an output coupled to a suitable warning device such as a warning lamp 68. Thus, when the maximum gas temperature Tgm is equal to or less than a predetermined limit value Ts of, that is to say, 100 degrees C°, the malfunction detector circuit 66 will give a warning signal for causing the warning lamp 68 to glow.

Operation of the Malfunction Detection System

Figure 3:
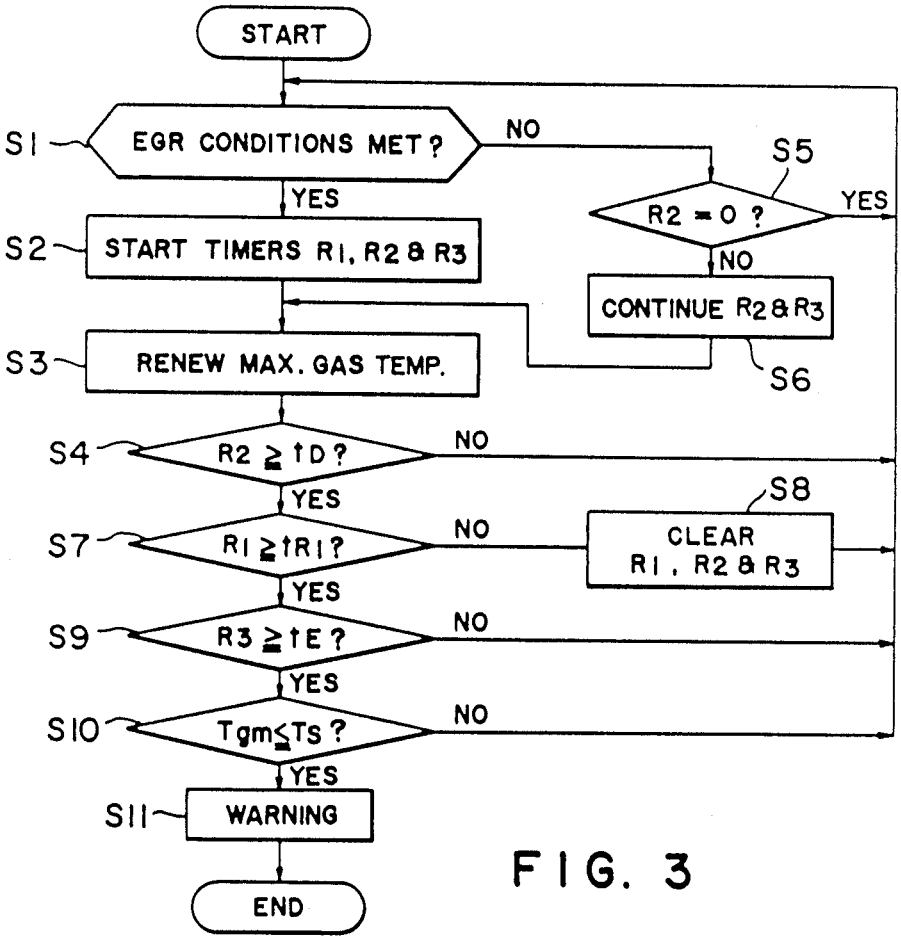
FIG. 3 is a flow chart explanatory of the method of detecting malfunctions in the EGR system of FIG. 1 in accordance with the invention.
Figure 4:
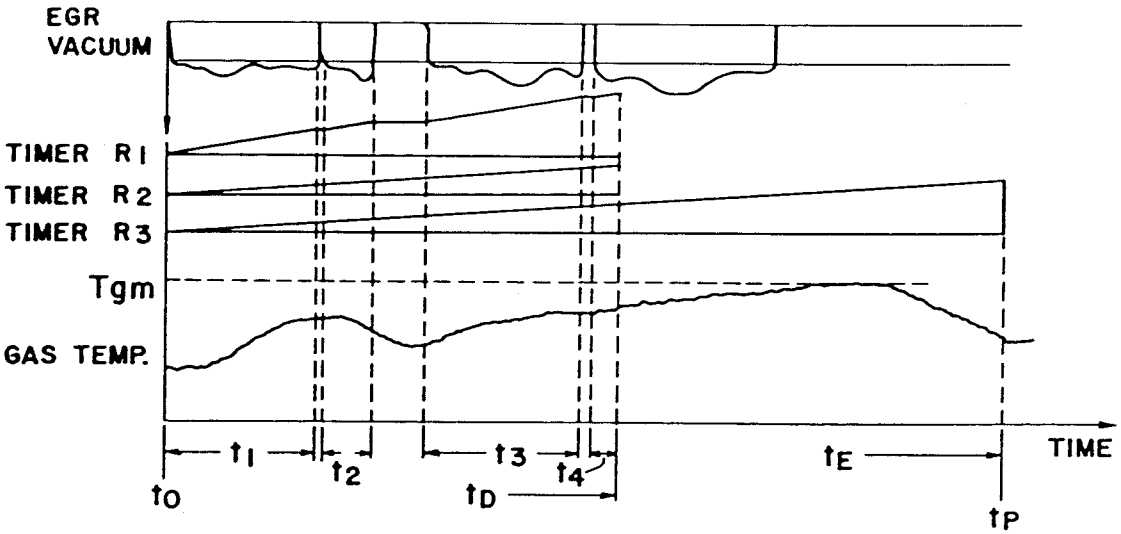
FIG. 4 is a time chart also explanatory of the method of malfunction detection in accordance with the invention.

The diagnostic routine of the EGR malfunction detection control circuit 54 will be better understood by referring to the flow chart of FIG. 3, taken together with the timing diagram of FIG. 4.

It is assumed that the prescribed set of operating conditions, set forth with reference to FIG. 1, are all met at a time tO in FIG. 4 soon after the startup of the vehicle. Exhaust gas recirculation commences at this moment. However, as a series of manual upshifts are made for acceleration after the vehicle startup, the exhaust gas recirculation will be suspended during each such upshift. Thus, in FIG. 4, the numerals t1, t2, t3, . . . indicate the periods of time during which exhaust gas actually recirculates after the time t0. The diagnostic routine of FIG. 3 will be explained hereafter in conjunction with the showing of FIG. 4.

As the diagnostic routine is started, it is first checked at a step Sl whether or not the prescribed set of engine operating conditions are met. If the coolant temperature, throttle opening, and engine speed satisfy the required conditions, and if the solenoid valve 36 is open, the pressure in the throttle body will act via the solenoid valve on the EGR valve 22 thereby causing the same open. Part of the exhaust gas will then be sent back from the exhaust manifold 18 to the intake manifold 16 through the EGR valve 22. Exhaust gas recirculation, thus, starts as at t0 in FIG. 4. The monitoring circuit 52 detects the fact that the EGR conditions, by which are meant the noted conditions warranting exhaust gas recirculation, have all been met at t0.

Then, at a step S2, the output from the monitoring circuit 52 simultaneously triggers three timers R1, R2 and R3 into operation. These timers are built into the adding circuit 58, delay time setting circuit 56 and diagnosis time setting circuit 60, respectively. The first timer R1 measures and cumulatively adds up the successive periods t1, t2, t3, . . . during which exhaust gas recirculates, and will therefore be referred to as the summing timer hereafter. The second timer R2 measures the preset delay time tD starting at the moment t0. The third timer R3 measures the preset diagnosis time tE starting at the moment t0. The timers R2 and R3 may therefore be termed the delay timer and the diagnosis timer, respectively.

At a step S3, the recording of the maximum exhaust gas temperature being measured by the temperature sensor 42 is renewed at the maximum temperature detecting circuit 62. Then, at a step S4 the delay timer R2 is checked to see if the delay time tD has passed.

It has been assumed in connection with FIG. 4 that exhaust gas recirculation momentarily stops upon lapse of the time t1, much less than the delay time tD, from the moment t0. The EGR conditions are not all met at this time. Accordingly, the diagnostic routine deviates from step S1 to step S5, at which step the delay timer R2 is checked to see if it is zero. If not, that is, if the delay timer R2 has already started counting the delay time tD, then at the next step S6 the delay timer R2 and diagnosis timer R3 are both maintained in operation but the summing timer R1 is set out of operation. The operation of the summing timer R1 is restarted through the steps S1 and S2 when exhaust gas resumes recirculating after the first gearshift.

It will therefore be apparent that the operation of the summing timer R1 is similarly suspended during the subsequent gearshifts taking place after the periods t2 and t3, as well. Thus the summing timer R1 cumulatively adds up the successive periods of time t1, t2, t3, etc., during which exhaust gas recirculates, until the delay time tD elapses in the course of the period t4.

The diagnostic routine progresses from step S4 to step S7 upon lapse of the delay time tD after the moment t0. At this step S7, the sum $R_l$ of the periods t1, t2, etc., is compared with the predetermined reference time tR1 by the diagnosis determination circuit 64. If the sum $R_l$ is less than the reference time tR1, this means that the total time of exhaust gas recirculation has been too short for accurate measurement of the recirculating exhaust gas temperature by the sensor 42. Therefore, at a step S8, the present diagnostic routine is cut short by clearing all the timers R1, R2 and R3.

If the sum $R_l$ is equal to or more than the reference time tR1, on the other hand, then exhaust gas has recirculated for a sufficiently long total period of time to enable the temperature sensor 42 to accurately measure the temperature of the recirculating exhaust gas. The diagnostic routine proceeds from step S7 to step S9, at which the diagnosis timer R3 is checked to see if the diagnosis time tE is up. Upon lapse of the diagnosis time tE at a moment tP in FIG. 4, the malfunction detector circuit 66 diagnoses the EGR system 20 at a step S10 by comparing the maximum temperature Tgm of the recirculating exhaust gas with the predetermined limit value Ts.

If the maximum gas temperature Tgm is more than the predetermined limit value Ts, this means that the EGR system 20 operated properly. Then the diagnostic routine will return to the step S1 and will be restarted as the prescribed set of engine operating conditions, which are constantly monitored by the monitoring circuit 52, are met subsequently.

The maximum gas temperature Tgm may be equal to or less than the limit value Ts because of some such malfunctions of the EGR system 20 as the malfunctioning of the EGR valve 22. Then, at a step S11, the malfunction detector circuit 66 will put out a warning signal with the consequent glowing of the warning lamp 68. In this case the diagnostic routine will not be repeated, and the warning lamp 68 will continue glowing by flag setting.

Although the invention has been herein disclosed in an environment of an automotive engine associated with a manual transmission, it is not desired that the invention be limited by this particular application, or by the exact details of this disclosure. Numerous changes in construction and circuitry and widely differing embodiments and applications of the invention will suggest themselves without departure from the scope of the invention.

What is claimed is:

1. A method of detecting malfunctions in an exhaust gas recirculation system for an internal combustion engine, wherein exhaust gas recirculates only when a prescribed set of operating conditions of the engine are met, and wherein a temperature sensor is provided for sensing the temperature of the exhaust gas being recirculated, said method comprising the steps of:

(a) constantly monitoring the prescribed set of engine operating conditions for the commencement and progress of exhaust gas recirculation;

(b) setting up a prescribed length of delay time when the engine working conditions become satisfied;

(c) cumulatively adding up those parts of the delay time during which the engine operating conditions are met;

(d) comparing, upon lapse of the delay time, the sum of the times during which the engine operating conditions have been met, with a predetermined reference time which is less than the delay time; and (e) detecting possible malfunctions in the exhaust gas recirculation system on the basis of the maximum temperature of the exhaust gas sensed by the temperature sensor, only in cases where the sum of the times during which the engine operating conditons have been met is not less than the reference time.

2. The malfunction detecting method of claim 1 wherein the malfunction detection of said step of detecting possible malfunctions is performed upon lapse of a prescribed length of time, longer than the delay time, after the engine operating conditions become satisfied as in said step of setting up a prescribed length of delay time.

3. The malfunction detecting method of claim 1 which further comprises giving a warning when the maximum temperature of the exhaust gas is found not more than a predetermined limit value as a result of the malfunction detection of said step of detecting possible malfunctions.

4. A system for detecting malfunctions in an exhaust gas recirculation system for an internal combustion engine, wherein exhaust gas recirculates only when a prescribed set of operating conditions of the engine are met, and wherein a temperature sensor is provided for sensing the temperature of the exhaust gas being recirculated, said system comprising:

(a) a monitoring circuit for constantly monitoring the prescribed set of engine operating conditions for the commencement and progress of exhaust gas recirculation;

(b) a delay time setting circuit coupled to the monitoring circuit for setting up a prescribed length of delay time when the engine operating conditions become satisfied;

(c) an adding circuit coupled to the monitoring circuit for cumulatively adding up those parts of the delay time during which the engine operating conditions are met;

(d) a diagnosis determination circuit coupled to both the delay time setting circuit and the adding circuit for comparing, upon lapse of the delay time, the sum of the times during which the engine operating conditions have been met, with a predetermined reference time which is less than the delay time;

(e) a temperature detecting circuit coupled to the monitoring circuit and responsive to an output from the temperature sensor for detecting the maximum temperature of the exhaust gas being recirculated; and (f) a malfunction detector circuit coupled to both the diagnosis determination circuit and the temperature detecting circuit for detecting possible malfunctions in the exhaust gas recirculation system on the basis of the maximum temperature of the exhaust gas, only in cases where the sum of the times during which the engine working conditions have been met is not less than the reference time.

5. The malfunction detecting system of claim 4 further comprising a diagnosis time setting circuit coupled to the monitoring circuit for setting up a prescribed length of diagnosis time when the engine operating conditions become satisfied, the diagnosis time being longer than the delay time, and wherein the malfunction detector circuit is further coupled to the diagnosis time setting circuit for detecting malfunctions in the exhaust gas recirculation system upon lapse of the diagnosis time after the engine operating conditions have become satisfied.

6. The malfunction detecting system of claim 4 further comprising a warning device coupled to the malfunction detector circuit for giving a warning when the maximum temperature of the exhaust gas is not more than a predetermined limit value.

* * * * *